United States Patent [19]

Bronander, Jr.

[11] 4,406,364

[45] Sep. 27, 1983

[54] WRAPPED COMBINATION OF SOAP AND RECEPTACLE FOR THE SOAP

[75] Inventor: Wilhelm B. Bronander, Jr., Upper Montclair, N.J.

[73] Assignee: Scandia Packaging Machinery Company, Clifton, N.J.

[21] Appl. No.: 299,242

[22] Filed: Sep. 3, 1981

[51] Int. Cl.[3] ..... A47K 5/03; A47K 5/08; B65D 65/16

[52] U.S. Cl. ..... 206/77.1; 206/45.33; 252/93

[58] Field of Search ..... 206/77.1, 45.33, 45.31; 252/90, 93

[56] References Cited

U.S. PATENT DOCUMENTS

| | | | |
|---|---|---|---|
| 1,657,391 | 1/1928 | Haney | 206/232 X |
| 2,364,575 | 12/1944 | Warren | 252/93 X |
| 2,603,032 | 7/1952 | Huber | 206/77.1 X |
| 2,706,075 | 4/1955 | Buttery | 206/45.33 |
| 2,722,361 | 11/1955 | Kindseth | 206/45.33 X |
| 2,771,988 | 11/1956 | Sweeney | 206/216 |
| 2,790,589 | 4/1957 | Moore | 206/45.31 |
| 2,930,160 | 3/1960 | Pohl | 206/77.1 |

FOREIGN PATENT DOCUMENTS

| | | | |
|---|---|---|---|
| 1914415 | 10/1970 | Fed. Rep. of Germany | 206/77.1 |
| 1439910 | 4/1966 | France | 206/77.1 |

*Primary Examiner*—Joseph Man-Fu Moy
*Assistant Examiner*—Brenda J. Ehrhardt
*Attorney, Agent, or Firm*—Neil F. Markva

[57] ABSTRACT

The wrapped combination of a cake of soap and disposable receptacle or tray for holding the soap after unwrapping of the combination. Thus, the wrapped combination provides a soap package with its own tray as a part of the package.

8 Claims, 7 Drawing Figures

FIG. 4
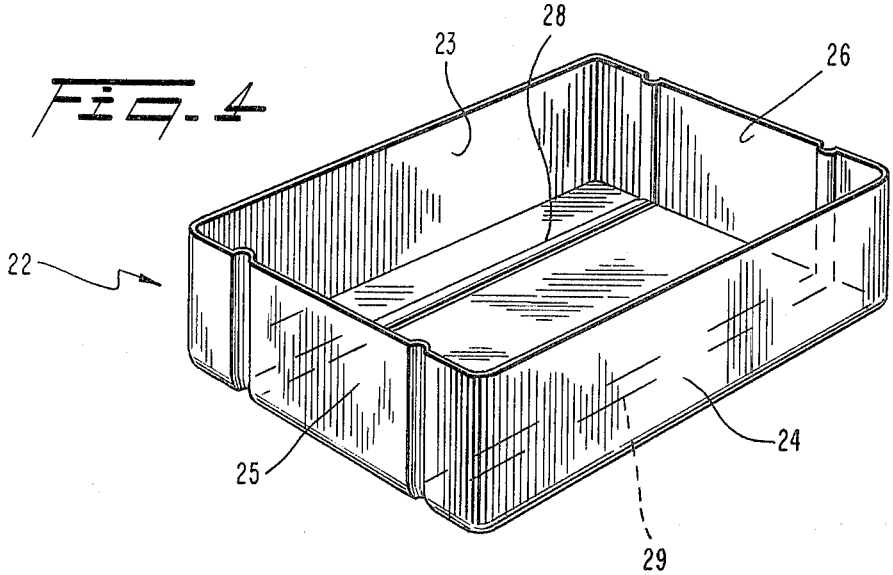
FIG. 5
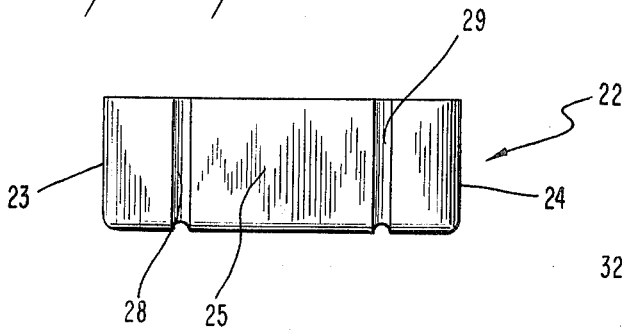
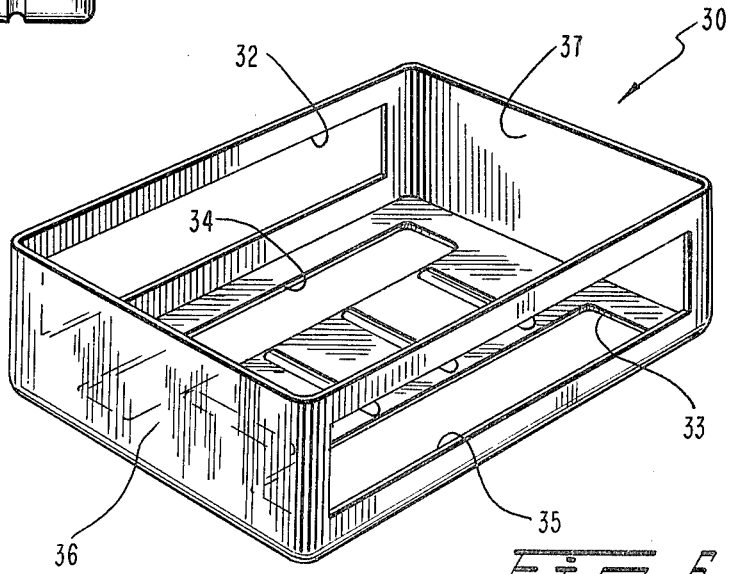
FIG. 6
FIG. 7
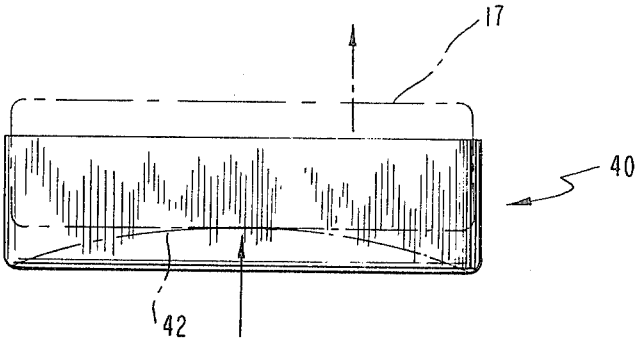

WRAPPED COMBINATION OF SOAP AND RECEPTACLE FOR THE SOAP

BACKGROUND OF THE INVENTION

This invention relates to a package for soap, and more particularly, to a wrapped soap package with its own disposable tray as a part of the package.

Soap cakes or bars are conventionally packaged in a paper overwrap, usually with a stiffer paper or cardboard piece at least partially wrapped around the cake of soap between the soap and the paper wrapper. Sometimes, the cake of soap is wrapped in a paper wrapper and placed in a cardboard box. Advertising material is typically placed on the overwrap and/or box.

With conventional soap packages, once the overwrap is removed and the package opened there is nothing within which to place the cake of soap as it is being used. In other words, the soap cake is either placed upon the edge of the sink or the user provides a tray or receptacle within which to place the soap cake. If no tray is provided, the soap quickly becomes wet and messy, with soap residue being left on the sink as the soap cake is repeatedly used. However, when the user is travelling away from home, it is not always convenient to provide a soap tray, so there is no choice but to place the soap cake upon the edge of the sink.

Examples of prior art soap packages are shown in U.S. Pat. Nos. 740,440, 1,657,391 and 2,603,032. Of these, U.S. Pat. Nos. 740,440 and 2,603,032 show soap cakes with protective covers 2, 3 and 5, respectively applied permanently to the face of the soap cake. In addition, U.S. Pat. Nos. 2,752,724 and 2,930,160 show soap trays for holding a cake of soap. None of these patents, however, teach the wrapped soap package concept of the present invention.

PURPOSE OF THE INVENTION

The primary object of this invention is to provide a wrapped soap package which includes its own tray or receptacle as a part of the package.

Another object of the invention is to provide a wrapped soap package in which a disposable tray for the soap is a part of the package, and wherein the soap is readily removable from the tray for use when desired.

A further object of the invention is to provide a wrapped combination of a cake of soap with a disposable tray for the soap cake wherein advertising material and the like may be placed upon the tray or other parts of the package. Thus, in one embodiment of the invention, the need is eliminated for some of the wrapping or packaging materials which have no other function once the package is opened.

SUMMARY OF THE INVENTION

These objects and other advantages are accomplished by the wrapped soap package combination described herein. A rectangularly shaped container for the soap cake forms a part of the wrapped combination. The container may be a disposable tray which holds the soap cake and is overwrapped with a sheet of overwrap material in an amount and in a manner to surround both the soap cake and the tray. The soap cake is readily removable from the tray during use, whereby the tray does not interfere with use of the soap. Use of a soap tray as a part of a wrapped package combination eliminates the need for some of the packaging materials commonly used in such packages and which have no other function once the package is opened.

Another feature of the invention is that the structural configuration of the container has an amount of stiffness to provide a solid backing against which the overwrap material may be tucked, folded and sealed during the wrapping operation and to further provide support for the soap after the wrapped package is opened. In one embodiment the rectangularly shaped container is a tray having four upstanding sides which extend upwardly with upper edges being located along a plane that is co-extensive with the upwardly facing side of the soap cake disposed in the tray.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 4 is a perspective view of a modified container;

FIG. 5 is an end view in elevation of the container of FIG. 4;

FIG. 6 is a perspective view of another embodiment of a container for a wrapped package combination made in accordance with this invention; and FIG. 7 is a side view in elevation of a still further form of container for a wrapped combination of the invention.

DETAILED DESCRIPTION

Figure 1:
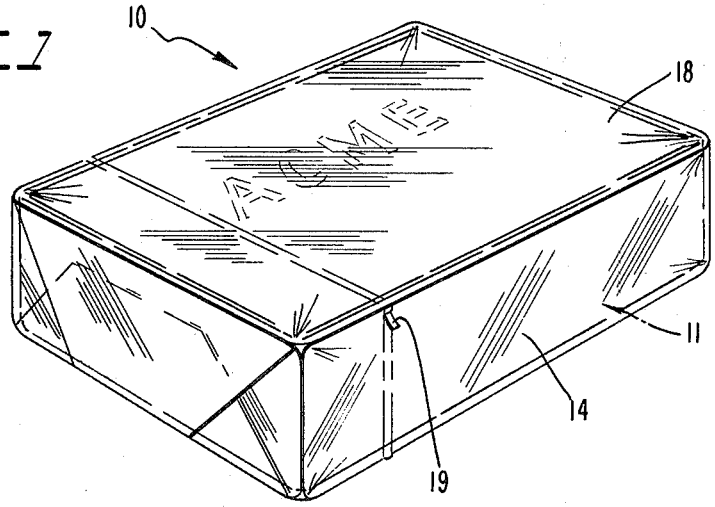
FIG. 1 is a perspective view of a wrapped soap package combination in accordance with this invention.

More specifically, referring to the drawings, the wrapped soap package combination generally designated 10, includes a tray or receptacle 11 having a bottom 12, opposite sides 13 and 14 and opposite ends 15 and 16. A soap cake 17 rests in tray 11 and a sheet of overwrap material 18 surrounds the assembled tray 11 and soap cake 17. That is, the sheet of overwrap material 18 is wrapped around tray 11 and soap cake 17 in an amount and in a manner effective to hold the soap cake 17 in assembled relationship with tray 11 for storing, shipping and marketing of the soap. Tray 11 has a structural configuration effective for holding soap cake 17 after the wrapped package 10 is opened. The overwrap includes a tear strip 19 to facilitate opening of package 10. As is evident in the drawings and as is disclosed herein, tray 11 is a rigid container and the overwrap material 18 is disposable and is tightly and removably wrapped around tray 11 as described below. Either or both of tray 11 and overwrap material 18 may be transparent or translucent, as desired, and either or both may carry advertising material or other indicia. By way of example, tray 11 may comprise plastic material having an amount of stiffness effective to provide a solid backing against which the overwrap material 18 may be tucked, folded, and sealed during the wrapping operation. The overwrap material 18 may comprise a treated paper, cellophane, a heat sealable material such as polypropylene or polyethylene and the like. The overwrapping operation may be similar to that used to overwrap cigarette packages such as by a Scandia packaging machine as disclosed, for example, in U.S. Pat. No. 3,373,655. With the particular structural configuration of tray 11 according to this invention, the soap cake 17 may have any type of shape and still be capable of being wrapped tightly for extended shelf life in accordance with available, rapid and efficient overwrapping equipment.

Figure 2:
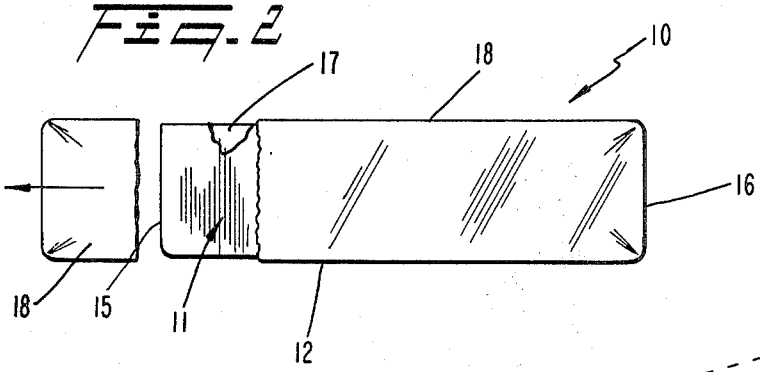
FIG. 2 is a side view in elevation of the package combination of FIG. 1, with part of the overwrap removed.
Figure 3:
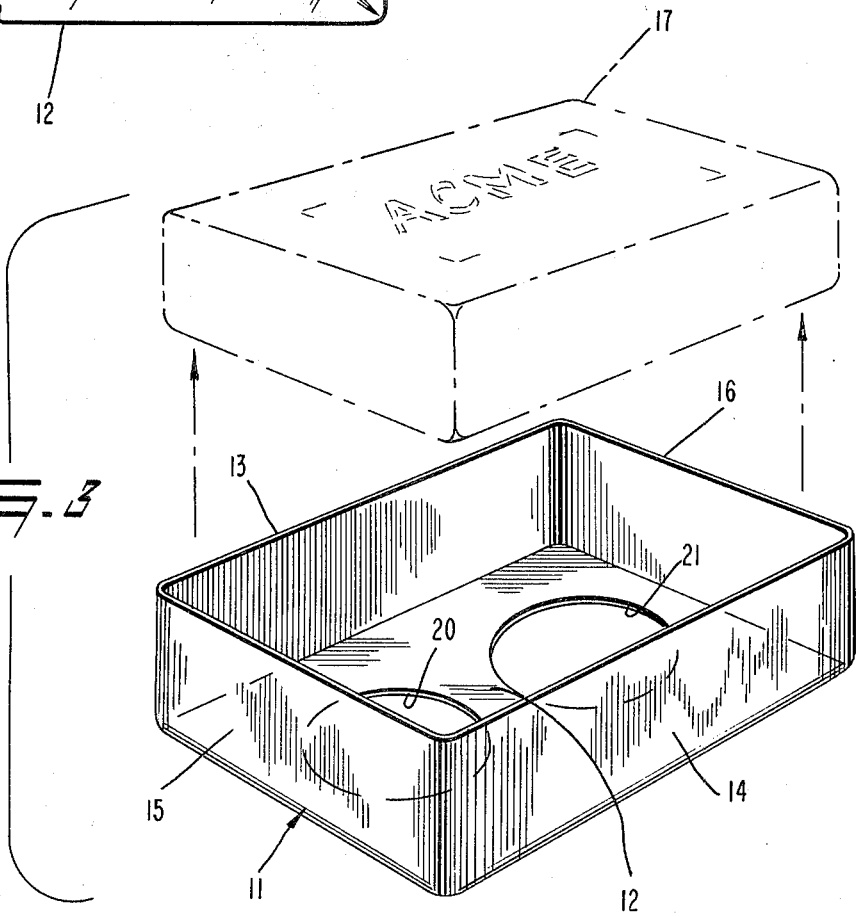
FIG. 3 is an exploded perspective view of the package of FIGS. 1 and 2, with the soap removed from the container.

As shown in FIGS. 1, 2 and 3, the sides 13 and 14 and ends 15 and 16 of tray 11 extend upwardly along the sides of soap cake 17. The upper edges of sides 13 and 14 and ends 15 and 16 are located along a plane that is coextensive with the upwardly facing side of soap cake 17 disposed in tray 11. The bottom 12 may have one or more openings or relatively yieldable portions 20 and 21, whereby an upward force may be exerted against the soap cake 17 to assist in releasing it from tray 11, if desired or necessary. The rectangularly shaped tray 11 with the disposition of the soap cake 17 therein enables the overwrapping with a flexible wrapping material 18 to be effected rapidly and further is effective for holding the soap cake 17 after the wrapped package 10 is opened.

A modified tray 22 is shown in FIGS. 4 and 5, and is substantially similar to that illustrated in FIGS. 1 through 3. However, one or more raised ribs 28 and 29 are formed in bottom 27 for preventing substantial area contact of a cake of soap with the tray bottom. Moreover, as seen in FIG. 5, the sides 23, 24, and ends 25, 26 extend upwardly substantially to the height of the thickness of soap cake 17.

A further modified tray 30, shown in FIG. 6, includes a substantially open frame configuration with substantial openings or cut-away parts 32 and 33, 34 and 35, in the sides and bottom respectively. This tray 30 enables excess water to drain away from the soap cake 17 after the package is unwrapped and tray 30 functions as a used soap holder or container. The ends 36 and 37 are continuously solid, opposite side portions which form a sufficient backing against which the overwrap material is tucked, folded and sealed.

In FIG. 7, tray 40 is substantially similar to that shown in FIGS. 1–3. However, bottom 42 is flexible or yieldable to allow the soap cake 17 to be pushed upwardly, if desired or necessary. This feature is particularly useful once soap cake 17 has been used and there may be a certain amount of adherance to the tray material.

The wrapped soap package combination described herein is economical and eliminates the need for some of the packaging materials conventionally used. Additionally, it provides its own receptacle or tray for holding the soap after the package is opened. This tray may carry advertising or other indicia which will thus be visible throughout the life of the cake of soap. Moreover, the package may be easily wrapped on existing machinery. It is also contemplated that some soap producers may wish to wrap the soap cake separately before placing same into a container. This assembled subcombination would then be overwrapped to form a wrapped soap package combination according to the invention.

While the wrapped combination of soap and receptacle for the soap has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A wrapped soap package combination comprising:

(a) a rectangularly shaped rigid plastic container having a bottom, opposite ends, opposite sides and an open top;

(b) a single cake of soap readily releasably received in the container; and (c) a sheet of disposable overwrap material tightly and removably wrapped around the container and soap cake with a sealed tuck and fold structure on opposed sides of the container, (d) said overwrap including a tear strip to facilitate removal of the overwrap material from the wrapped soap package combination, (e) said overwrap material being in an amount and wrapped in a manner effective to hold the soap cake in assembled relation with the container for storing, shipping and marketing of the soap.

(f) the container having a structural configuration effective for holding the soap after the wrapped package is opened and including an opening for facilitating drainage and soap removal, (g) the structural configuration of the container having an amount of stiffness effective to provide a solid backing against which the overwrap material has been tucked, folded and sealed to form said sealed tuck and fold structure during the wrapping operation and to further provide support for the soap during use of the soap after the wrapped package is opened and the overwrap material is disposed of.

2. A wrapped soap package combination as defined in claim 1 wherein the bottom of the container includes means to facilitate removal of the soap cake from the container.

3. A wrapped soap package combination as defined in claim 2 wherein said means to facilitate removal of the soap cake from the container comprises raised ribs on the bottom to prevent substantial area contact between the soap cake and the bottom of the container.

4. A wrapped soap package combination as defined in claim 2 wherein said means to facilitate removal of the soap cake from the container comprises relatively yieldable portions in the bottom of the container whereby upward force may be exerted on the soap cake to urge it from the container.

5. A wrapped soap package combination as defined in claim 2 wherein said opening comprises cut-away portions in the bottom of the container.

6. A wrapped soap package combination as defined in claim 1 wherein the rectangularly shaped container is a tray having four upstanding side portions which extend upwardly with upper edges being located along a plane that is coextensive with the upwardly facing side of the soap cake disposed in the tray.

7. A wrapped soap package combination as defined in claim 6 wherein two opposite side portions of the tray are continuously solid for forming a sufficient backing against which the overwrap material is tucked, folded and sealed.

8. A wrapped soap package combination as defined in claim 1 wherein the cake of soap is wrapped in a flexible wrapping material and placed in the container in a wrapped condition.

* * * * *